United States Patent [19]

Mawby et al.

[11] Patent Number: 4,920,696

[45] Date of Patent: May 1, 1990

[54] REFRIGERATION COMPRESSOR MOUNT

[75] Inventors: Harold S. Mawby, Belding; Douglas E. Weaver, Greenville, both of Mich.

[73] Assignee: While Consolidated Industries, Inc., Cleveland, Ohio

[21] Appl. No.: 306,775

[22] Filed: Feb. 3, 1989

[51] Int. Cl.[5] ..... F25D 11/00

[52] U.S. Cl. ..... 312/214; 62/465; 248/674; 312/257.1

[58] Field of Search ..... 312/214, 223, 257 SM, 312/257 A, 263; 62/448, 451, 465, 466; 248/674

[56] References Cited

U.S. PATENT DOCUMENTS

| | | | |
|---|---|---|---|
| 1,768,774 | 7/1930 | Mason | 62/465 |
| 2,341,961 | 2/1944 | Tanner | 62/465 |
| 2,602,305 | 7/1952 | Johnson | 62/466 |
| 2,672,029 | 3/1954 | Saunders | 62/465 |
| 3,588,214 | 6/1971 | Stimamiglio | 312/214 |
| 4,726,636 | 2/1988 | Voigt | 312/257.1 |

*Primary Examiner*—Kenneth J. Dorner
*Assistant Examiner*—Gerald A. Anderson
*Attorney, Agent, or Firm*—Pearne, Gordon, McCoy & Granger

[57] ABSTRACT

A refrigerated cabinet assembly has an open compressor compartment at the lower rear side thereof and the compartment is defined by the side walls of the cabinet and an insulation bottom support having a vertically extending wall portion. The refrigeration compressor is secured to a mounting plate which at one side is secured to a transverse rail extending between the two wall portions, while the mounting plate on the side opposite said rail has a projecting tongue received in an elastomeric bushing mounted in an opening on said vertically extending wall portion, with the bushing extending into and being surrounded by the rigid insulating foam.

11 Claims, 5 Drawing Sheets

REFRIGERATION COMPRESSOR MOUNT

BACKGROUND OF THE INVENTION

This invention relates generally to refrigerators of the household type, and more particularly to an arrangement for mounting the compressor in a household refrigerator which uses a minimum of separate fasteners and allows the compressor to be premounted on a support frame that is easily assembled on the refrigerator cabinet.

Household refrigerators of varying sizes take the form of a rectangular box for which an important design parameter is to obtain the maximum interior space within a box of minimum exterior dimensions. While a certain amount of space must be allocated to the thickness of the insulation in the walls and interior partitions, such as the partition between the freezer compartment and the food compartment, as well as the evaporator which is mounted within the frozen food compartment or closely adjacent thereto, the compressor and the condenser are the major space occupying elements of the refrigeration system that must be mounted on the exterior of the insulated compartment.

While the condenser may be either mounted as a flat member on the back of the cabinet or as a coiled member beneath the bottom wall of the insulation space, it is often the compressor, with its relatively large size and relatively boxy shape, that requires the most space. Thus, the most common location for the compressor on current household refrigerators is within a compressor compartment formed at the bottom rear side of the cabinet which allows minimum intrusion into the insulated space.

When the compressor compartment is located at the lower rear portion of the cabinet, it is recognized that with compressors now having a relatively long life and with the replacement costing the consumer sometimes a substantial portion of the original price, replacement of the compressor in the field is not considered to be a significant problem in refrigerator design. Thus, the walls of the compressor compartment are generally made with a minimum of clearance for the compressor, consistent with necessary air circulation for cooling purposes. The compressor is normally mounted on three or four rubber bushings for vibration isolation, and these bushings, in turn, are mounted on either a plate or pair of rails at the bottom of the compressor compartment. Normally, the plate or rails are formed as an integral part of the cabinet during assembly, and on the assembly line it is necessary to place the compressor directly over the mounts on the rails and use suitable fasteners for securing the compressor in place. While some types of mounts use threaded fasteners, such as bolts, through each of the rubber bushings, this requires considerable cost and assembly time during manufacture. A more common arrangement currently is to have a plurality of projecting pins or posts formed on the plate or rails which project upward to extend through the rubber isolation bushing. The compressor then has projecting tabs with apertures that fit over these posts or pins which are adapted to receive a simple locking pin or hook to hold the compressor securely in place. Thus, this type of mounting arrangement does incur substantial labor costs during assembly, and extra care must be taken to ensure that the compressor is properly mounted with rubber isolation mounts to prevent the conduction of the vibrations from the compressor to other parts of the refrigerator system, which would result in an unacceptable amount of noise.

SUMMARY OF THE INVENTION

According to the preferred embodiment of the invention, the refrigeration cabinet is formed with an open compressor compartment at the bottom rear side. The cabinet is formed with an outer shell that extends completely over the side walls and an insulation bottom support panel extends between the side walls of the shell. At the top, the insulation support is secured to the back wall of the refrigerator and extends forwardly and downwardly toward the bottom, and preferably extends from a bottom point generally horizontally forward a short distance above the floor to allow air circulation beneath the refrigerator. On the sloping wall of the insulation bottom, a rubber socket is mounted and held in place by bent tabs on the metal of the insulation support and extends inwardly into the insulation space where the foam holds it securely in place.

The compressor mounting support comprises a rail arranged to extend from side to side across the lower rear portion of the compressor space in the cabinet, and near the middle the rail has a support plate attached to it. The support plate is preferably attached to the rail by a mechanical fastening system to allow easy use of galvanized or pre-painted material, and extends generally forwardly toward the insulation support, and on this flat area has a plurality of bent, upwardly projecting pins or posts on which the compressor is mounted. At the forward end, the plate is bent upwardly a spaced distance, and then is bent into a forwardly projecting tongue which fits within the rubber socket mounted in the insulation support. Thus, the compressor is supported at its rear edge along the rail, which may be attached to the cabinet at each side by a plurality of removable fasteners such as screws or bolts, while the front end of the compressor is supported by the tongue on the mounting plate extending into the rubber socket mounted on the insulation bottom support.

With this arrangement, after the rail and support plate are secured together, the compressor can be mounted on the projecting tabs, using rubber bushings and fastening clips in the usual manner, and this preassembly can be made at an area remote from the final assembly area for the refrigerator. When the compressor is to be mounted on the refrigerator, the compressor assembled on the mounting support is moved into the compressor space so that the projecting tongue on the support plate enters the socket. At the same time, the ends of the rail are aligned with the side walls of the refrigerator and secured thereto with a plurality of screws or similar fasteners with a minimum of effort by assembly line workers. After the compressor has been so mounted, the necessary electrical connections, as well as the tube connections to the compressor and evaporator, may be made to the compressor in the usual fashion.

Thus, with the present invention, the compressor can be premounted on the support assembly prior to the finished assembly of the refrigerator, and the connection of the compressor and support arrangement is quickly and easily made. Furthermore, the use of the projecting tongue on the support plate fitting into the rubber socket carried on the cabinet provides further vibration isolation in addition to that provided by the bushings on the mounting legs of the compressor.

DETAILED DESCRIPTION OF THE PREFERRED EMBODIMENT

Figure 1:
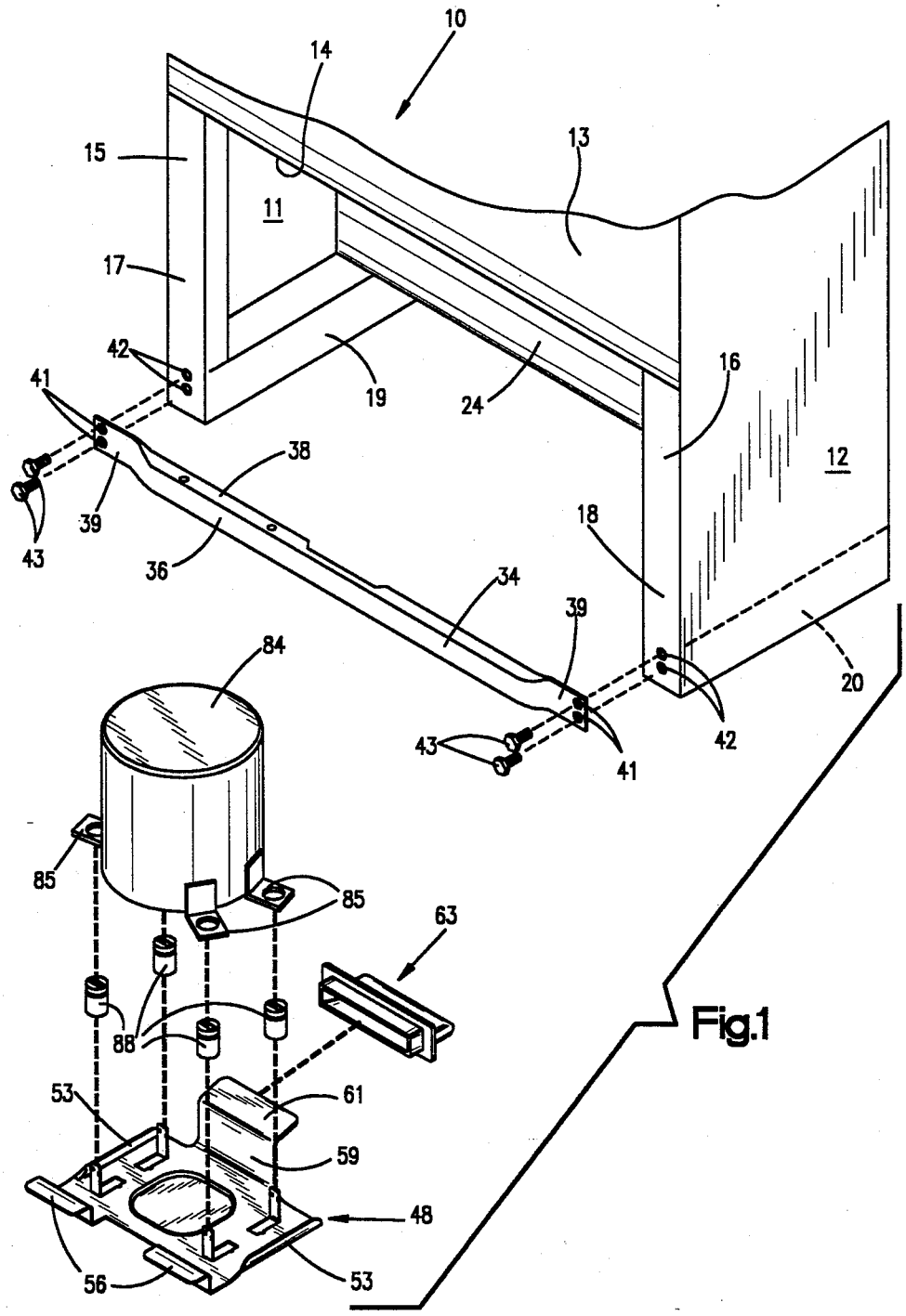
FIG. 1 is an exploded view of a portion of a refrigerator having an open compressor compartment, showing the mounting arrangement.
Figure 2:
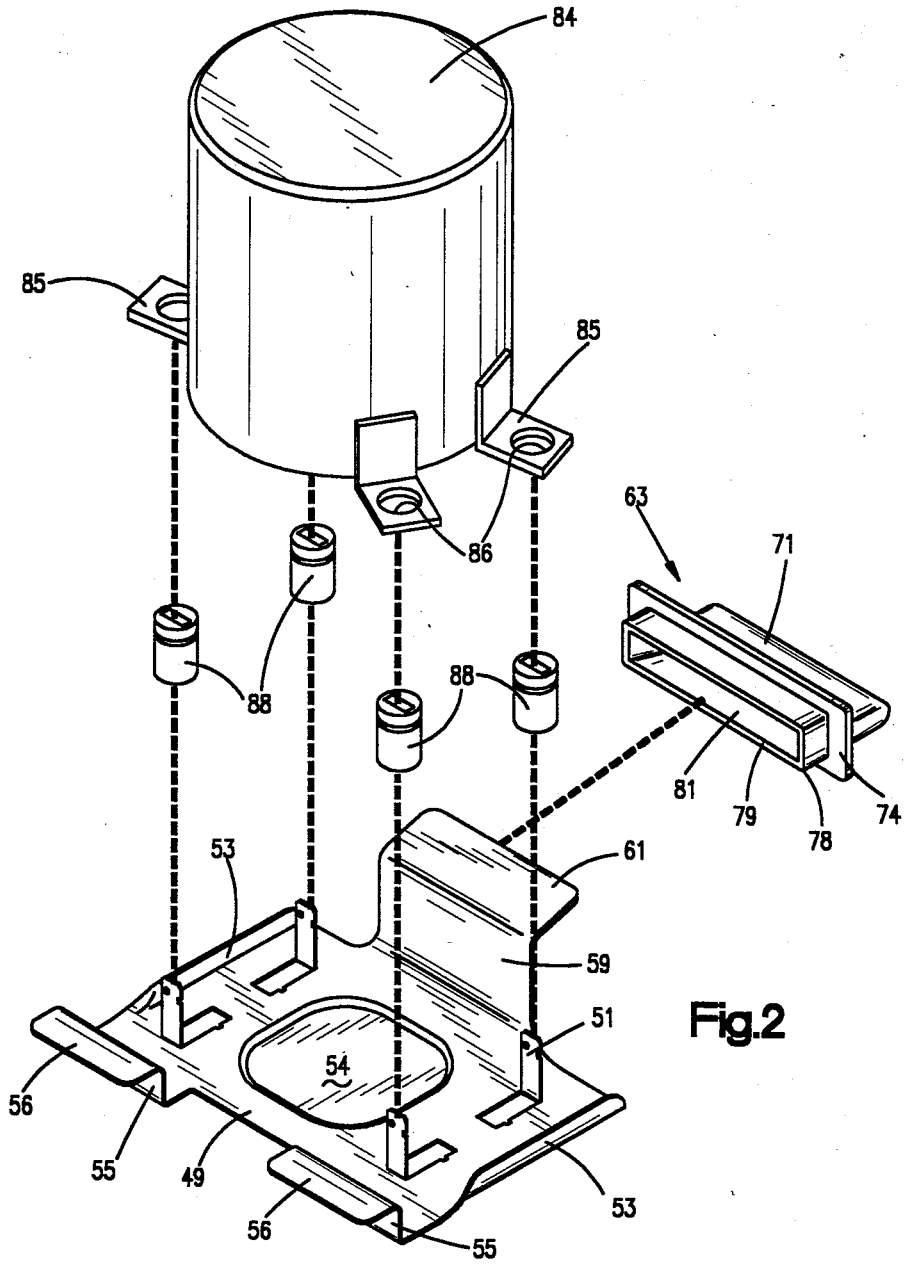
FIG. 2 is an enlarged, exploded view of the mounting of the compressor and the support plate and bushing.
Figure 3:
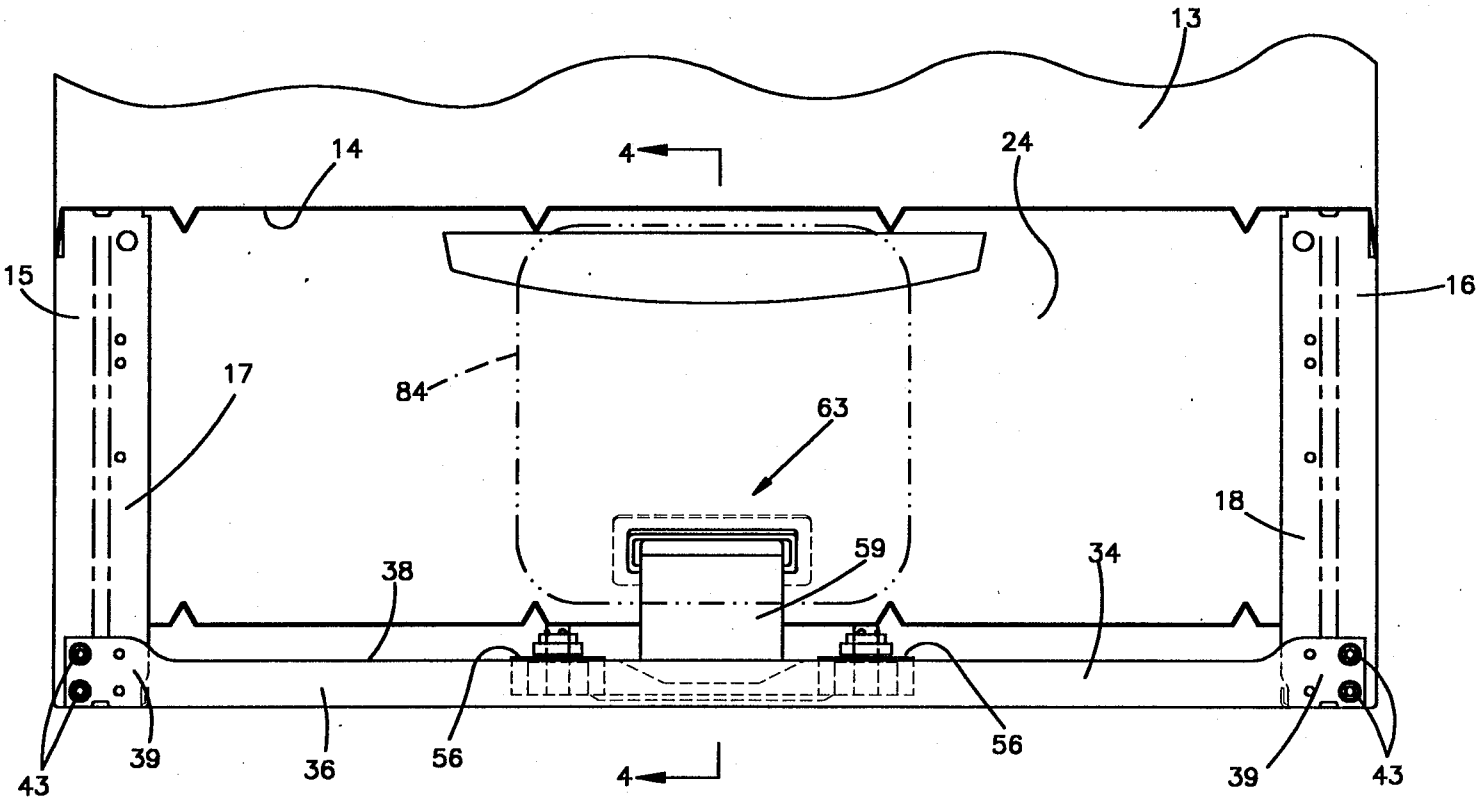
FIG. 3 is a rear elevational view of the compressor mounting compartment, showing the mounting of the rail, support plate, and support bushing.

Referring to the drawings in greater detail, FIG. 1 shows the lower rear portion of a refrigerator 10, which, as viewed from the rear, includes left and right side walls 11 and 12 which extend downward to terminate adjacent the floor so that when the refrigerator is viewed directly from the side, the side walls cover the full rectangular area of the side. A back panel 13 is secured to the cabinet and extends across between the side walls 11 and 12 to terminate in a lower edge 14 a spaced distance above the floor to define the top of the compressor compartment. To support the side walls 11 and 12, the refrigerator 10 is shown as having left and right frames 15 and 16 fitted just inside, and preferably secured to, the side walls 11 and 12 at the lower ends thereof. The frames 15 and 16 include vertical members 17 and 18 extending from the back panel lower edge 14 down to the floor, where they are connected with the horizontal portions 19 and 20 extending toward the front of the refrigerator along the lower edges of the side walls 11 and 12.

Figure 4:
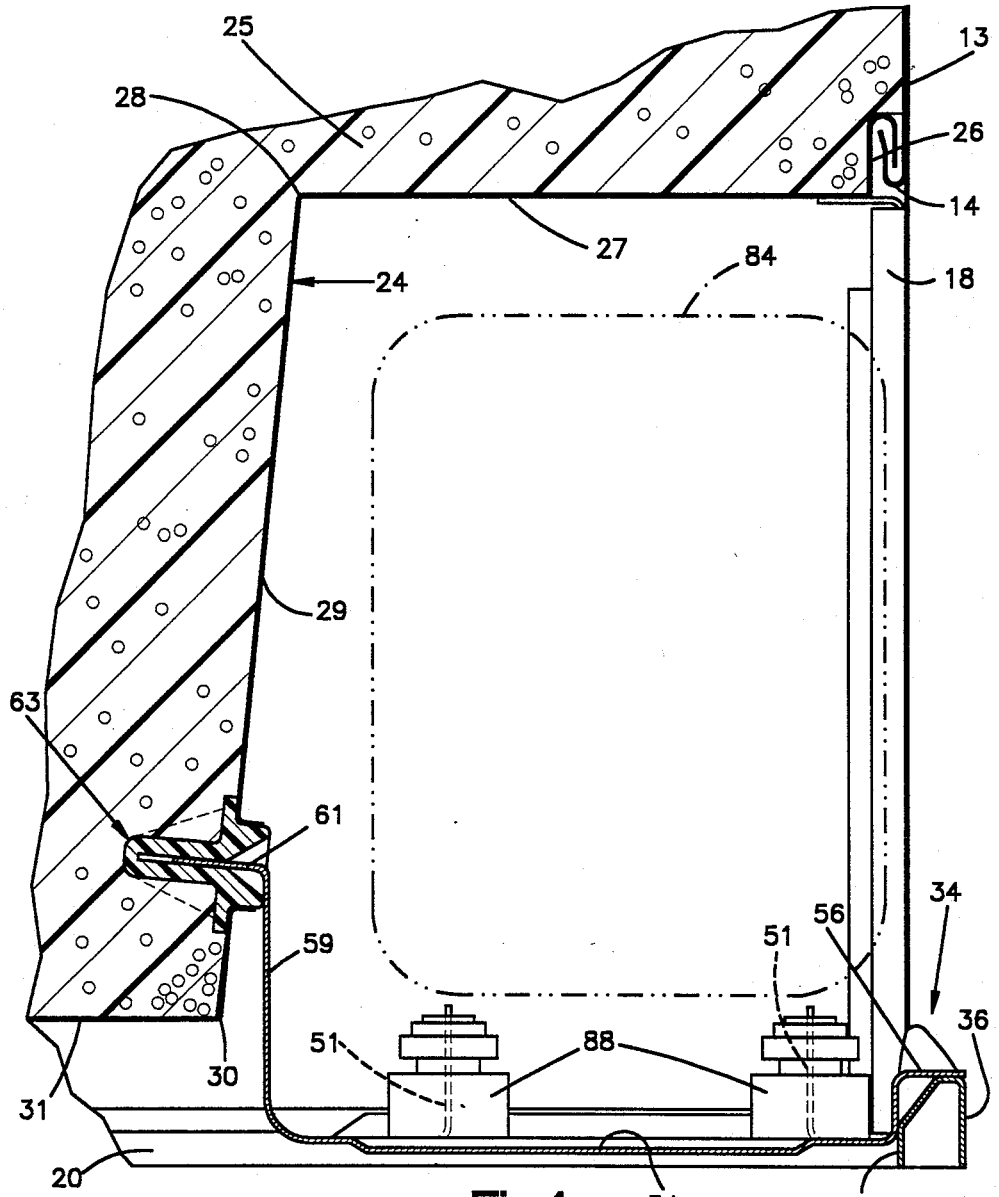
FIG. 4 is a cross-sectional view, with the compressor in phantom, taken on line 4—4 of FIG. 3.

The insulation support 24 (see FIG. 4) extends between the back panel 13 and the front of the refrigerator, and serves not only to contain the rigid polyurethane foam insulation 25 during the foaming process, but also to define the shape of the compressor compartment. The insulation support 24 at its rear edge is connected at 26 to the lower edge 14 of back panel 13 by suitable means, such as a folded seam, and has a top wall portion 27 extending forwardly to a bend 28, where it extends downwardly along a sloping but nearly vertical wall portion 29 to a bottom bend 30, from which point the bottom portion 31 extends forwardly to the front of the refrigerator to define an air space for circulation.

The compressor mounting structure includes a rail 34 preferably formed in an inverted channel having an outer or rear side wall 36 and inner or front side wall 37 joined together at the top by a top wall 38. At each end portion 39, the channel is flattened so that the side walls are adjacent, and each of the end portions 39 is provided with a pair of bolt holes 41 which align with tapped holes 42 in the vertical frame members 17 and 18 so that bolts, as indicated at 43, can be used to rigidly secure the rail to the refrigerator cabinet.

The mounting arrangement also includes a compressor mounting plate 48 having a central portion 49 on which are formed a plurality of lanced and bent posts 51 for axially mounting the compressor as described in greater detail hereinafter. The center portion 49 may be provided with upturned edges 53 for stiffening purposes and, likewise, the center portion 54 may be depressed for similar purposes. At the rear of each side, the mounting plate 48 has a pair of vertical offset wall portions 55 which have projecting horizontal arms 56 at their upper sides. The arms 56 rest on the rail top wall 38 near its midpoint and are attached thereto by welding or mechanical interlocking operations to ensure that the mounting plate 48 and rail 34 are permanently secured together as a unit, and such assembly is done prior to either mounting the compressor or attaching the mounting assembly to the refrigerator cabinet. At the other side, the mounting plate 48 has a centrally located, vertical offset wall 59, which, at its upper end, is formed with an angularly projecting, flat tongue 61 which is received in a bushing 63 on the sloping wall portion 29 of insulation support 24 (see FIGS. 4 and 5).

Figure 5:
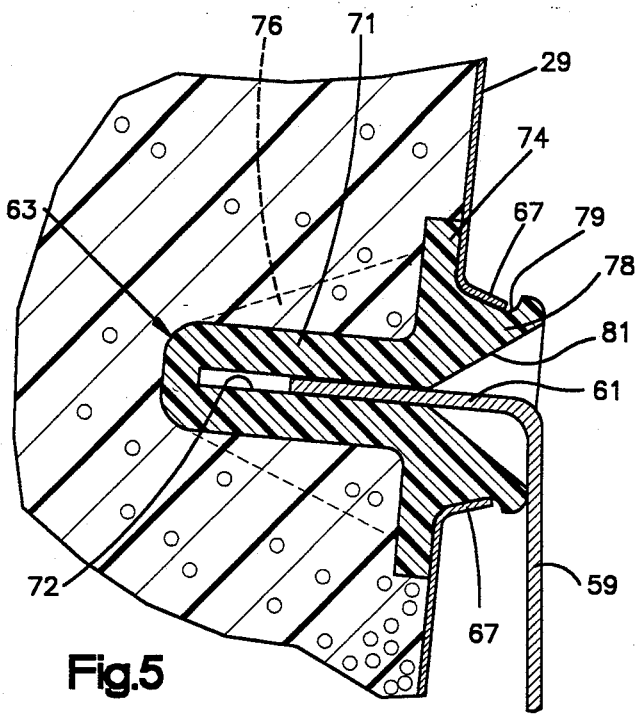
FIG. 5 is an enlarged, fragmentary, cross-sectional view through the support bushing, showing the support plate tongue engaged and details of the mounting of the bushing in the cabinet.
Figure 6:
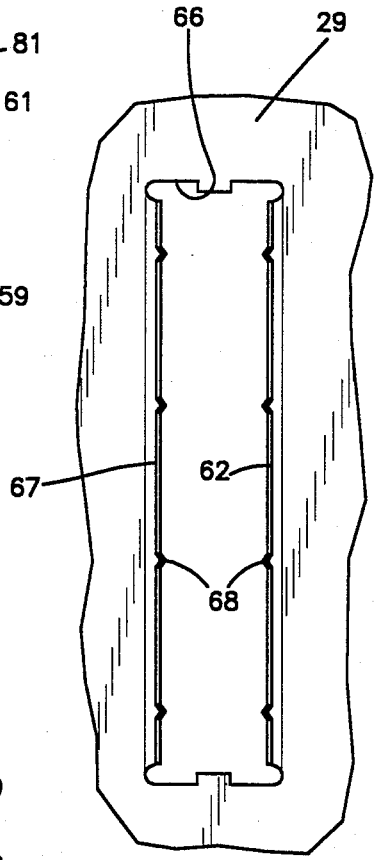
FIG. 6 is an enlarged, fragmentary view of the opening for the resilient socket.

The bushing 63 is mounted in the cabinet during assembly operations and prior to the foaming operation. In order to mount the bushing 63, the sloping wall portion 29 is provided with an opening 66 a spaced distance above the bottom bend 30, and opening 66 is provided with integrally outwardly extending lips 67 which are bent at an angle of less than 90 degrees so that they converge together at the outer edges which are provided with projecting teeth 68 (FIG. 6). The bushing 63 includes a body 71 defining a slot 72 and which extends inwardly into the insulation space away from a peripheral flange 74 which, as best shown in FIG. 5, abuts against the inner side of the sloping wall portion 29. The bushing 63 may also be provided with reinforcing ribs 76 extending between the body 71 and flange 74 to increase the ridigity of the bushing.

Bushing 63 has a rectangular projection 78 extending outwardly through lips 67 and having peripheral walls 79 which engage the lips 67 and teeth 68, which therefore rigidly grip the bushing. The projection 78 also includes a flaring mouth 81 extending outwardly from the slot 72 to allow easy assembly of the tongue 61 in the slot 72. During assembly, the bushing 63 is inserted in the opening 66 from the insulation side of the wall portion 69, and the lips 67 and teeth 68 will tend to hold it in place. After the foaming operation, the rigid foam completely surrounds the bushing portion which extends into the insulation space, and this, together with the lips 67, ensures a positive and immovable mounting for the bushing.

Figure 7:
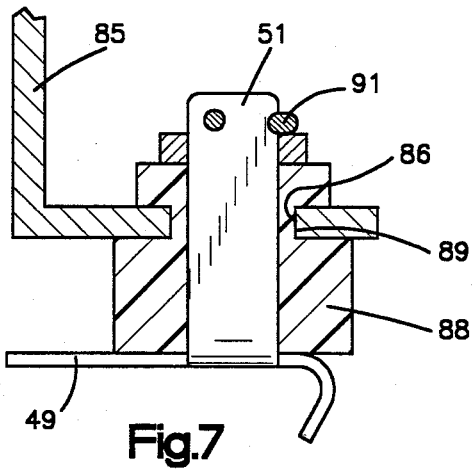
FIG. 7 is an enlarged, cross-sectional view, showing the mounting bushing and mounting plate for the compressor.

During assembly of the refrigerator, the bushing 63 will be mounted in place, as previously described, before the foaming operation, and after foaming has been completed, the refrigerator proceeds along the assembly line for the remainder of the assembly operations. At this time, the rail 34 and mounting plate 48 are separately assembled together as a unitary piece, and the compressor 84 is assembled onto the mounting plate prior to assembly with the refrigerator cabinet itself. The compressor 84 is mounted in the usual manner, and has a plurality of projecting feet 85 around the bottom, each of which has an opening 86 therein. A rubber mounting bushing 88 having a reduced diameter neck 89 (see FIG. 7) is assembled into each of the openings 86, after which the compressor is placed on top of the posts 51 and secured in place by suitable clip rings 91.

This is a subassembly operation and can be performed at a point remote from the assembly line together with other subassembly operations, such as the mounting of electrical and other components.

At the time of assembly of the compressor together with the rail and mounting plate 48, this subassembly is moved into the back of the refrigerator into the space beneath the insulation support 24 and the projecting tongue 61 on the mounting plate 48 is inserted through the mouth 81 into the slot 72, which is arranged to tightly grip the tongue 61 and isolate the structure from vibration. At that time, the rail ends 39 are aligned with the frame members 15 and 16 at the back of the refrigerator, and at this point, merely by assembling the bolts 43 through the holes 41 into the tapped holes 42, the mounting of the compressor is completed and the refrigerator is ready for the remaining assembly operations.

With the mounting arrangement of this invention, not only is the ease of assembly greatly improved, since assembly requires only moving the subassembly into place and securing the floor bolts 43, but the resulting mounting arrangement further reduces vibration transmission through the cabinet walls. While much of the vibration is absorbed through the customary rubber bushings 88 connecting the compressor 84 onto the mounting plate 48, the use of the bushing between the mounting plate and the insulation support 24 provides further isolation to avoid transmission of vibration from the compressor to the cabinet walls.

While the preferred embodiment of this invention has been shown and described in detail, it is recognized that various modifications and rearrangements may be resorted to without departing from the scope of the invention as defined in the claims.

What is claimed is:

1. A refrigerated cabinet assembly having a compressor compartment and a compressor within said compartment, said compartment being defined by a pair of side wall portions of said cabinet and a compartment wall extending between said side wall portions and including a vertically extending portion, a compressor support including a rail extending across said compartment and secured at each end to the adjacent side wall portion, a mounting plate secured at one side to said rail, said mounting plate extending horizontally from said rail toward said compartment wall, means securing said compressor to said mounting plate, a resilient bushing secured in said vertically extending portion of said compartment wall, and a tongue on said mounting plate extending into said bushing.

2. A refrigerated cabinet assembly as set forth in claim 1, wherein said compartment wall has an opening and said bushing is mounted in said opening.

3. A refrigerated cabinet assembly as set forth in claim 2, wherein said bushing has a peripheral flange abutting the side of said compartment wall opposite said compressor compartment around said opening.

4. A refrigerated cabinet assembly as set forth in claim 3, wherein said compartment wall has converging lips on opposite sides of said opening extending into said compressor compartment and gripping said bushing.

5. A refrigerated cabinet assembly as set forth in claim 4, wherein the space on the side of said compartment wall opposite said compressor compartment is filled with rigid insulating foam and said bushing extends into and is surrounded by said foam.

6. A refrigerated cabinet assembly as set forth in claim 1, wherein said rail is in the form of an inverted channel and said mounting plate is secured to the top wall of said channel.

7. A refrigerated cabinet assembly as set forth in claim 6, wherein the sides of said channel are flattened at each end and bolts extending through each end secure said ends to said side wall portions.

8. A refrigerated cabinet assembly having a compressor compartment and a compressor within said compartment, said compartment being defined by a pair of side wall portions of said cabinet and a compartment wall extending between said side wall portions and including a vertically extending portion, said side wall portions each including a frame portion extending vertically along the side of the compartment, a compressor support including a rail extending across said compartment and secured at each end to the adjacent frame portion, a mounting plate secured at one side to said rail, said mounting plate extending horizontally from said rail toward said compartment wall, means securing said compressor to said mounting plate, a resilient bushing secured in said vertically extending portion of said compartment wall, and a projection on said mounting plate extending into said bushing whereby said bushing and said rail provide the sole support for said mounting plate and said compressor in said compartment.

9. A refrigerated cabinet assembly as set forth in claim 8, wherein said projection on said mounting plate is a flat tongue and said bushing has a slot receiving said tongue.

10. A refrigerated cabinet assembly as set forth in claim 9, wherein said bushing is mounted in an opening in said compartment wall and has a portion on the other side of said compartment wall surrounded by rigid insulating foam.

11. A refrigerated cabinet assembly as set forth in claim 8, wherein said rail is an inverted channel and said mounting plate is secured to said rail near the midpoint between its ends.

* * * * *